US010888907B2

(12) United States Patent
Duan

(10) Patent No.: US 10,888,907 B2
(45) Date of Patent: Jan. 12, 2021

(54) MIXED JET DESCALING DEVICE AXIALLY AND ECCENTRICALLY ARRANGED FOR INNER WALL OF PIPE

(71) Applicant: BAOSHAN IRON & STEEL CO., LTD., Shanghai (CN)

(72) Inventor: Mingnan Duan, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 213 days.

(21) Appl. No.: 15/129,845

(22) PCT Filed: Jan. 30, 2015

(86) PCT No.: PCT/CN2015/071909
§ 371 (c)(1),
(2) Date: Sep. 28, 2016

(87) PCT Pub. No.: WO2015/143947
PCT Pub. Date: Oct. 1, 2015

(65) Prior Publication Data

US 2018/0345344 A1 Dec. 6, 2018

(30) Foreign Application Priority Data

Mar. 28, 2014 (CN) ..... 2014 1 0124038

(51) Int. Cl.
*B05B 1/20* (2006.01)
*B08B 9/032* (2006.01)
(Continued)

(52) U.S. Cl.
CPC ..... *B21B 45/08* (2013.01); *B05B 1/20* (2013.01); *B05B 15/555* (2018.02); *B05B 15/68* (2018.02)

(58) Field of Classification Search
CPC ..... B08B 9/027; B08B 9/0321; B08B 9/032; B08B 9/0433; B08B 9/045; B08B 9/0813;
(Continued)

(56) References Cited

U.S. PATENT DOCUMENTS 2,217,360 A * 10/1940 Court ..... B08B 9/0936 134/10
3,752,472 A * 8/1973 Snead ..... A63B 9/00 482/35
(Continued)

FOREIGN PATENT DOCUMENTS

CN 201186303 Y 1/2009
CN 201244599 Y 5/2009
(Continued)

OTHER PUBLICATIONS

JP2002045813—Machine Translation (Year: 2002).*
(Continued)

*Primary Examiner* — Marc Lorenzi
(74) *Attorney, Agent, or Firm* — Thomas Horstemeyer, LLP

(57) ABSTRACT

A mixed jet descaling device axially and eccentrically arranged for the inner wall of a metal pipe comprises a support rod (1) arranged inside the metal pipe (100), the support rod being parallel to the central axis of the metal pipe, eccentrically arranged and not concentric with the central axis of the metal pipe; and at least two spray nozzle units (2, 2', 2") for spraying the mixed jet, the spray nozzle units being arranged from front to back along the length direction of the support rod. At least two mixed jet spray nozzles (21, 21', 21") are provided in each spray nozzle unit and uniformly arranged along the circumference of the support rod in such a manner that the mixed jet spray nozzles diverge towards periphery of the support rod with the axis of the support rod as the center. The mixed jet spray nozzles of
(Continued)

the spray nozzle units arranged from front to back are staggered from front to back in the circumferential direction of the inner wall of the to-be-descaled metal pipe, thereby forming a mixed jet spray nozzle matrix and creating an effective descaling zone capable of completely covering the circumferential surface of the inner wall of the metal pipe. The descaling device can achieve continuous, high efficient, stable and environment-friendly descaling for the inner wall surfaces of cold-state metal pipes.

7 Claims, 4 Drawing Sheets

(51) Int. Cl.
*B21B 45/08* (2006.01)
*B05B 15/555* (2018.01)
*B05B 15/68* (2018.01)

(58) Field of Classification Search
CPC ..... B08B 9/093; B08B 9/0933; B08B 9/0936; B08B 9/04; B08B 9/043; B05B 15/555; B05B 15/658; B05B 15/68; B05B 1/20; B05B 1/205; E04F 17/126; B21B 45/04
USPC ..... 15/104.05; 134/166 C, 167 C, 168 C, 134/169 C, 199
See application file for complete search history.

(56) References Cited

U.S. PATENT DOCUMENTS

| | | | | |
|---|---|---|---|---|
| 3,827,634 | A * | 8/1974 | Hammelmann | B08B 9/0936 239/227 |
| 4,031,910 | A * | 6/1977 | Lawson | B08B 3/02 134/167 C |
| 4,067,293 | A * | 1/1978 | Probst | B05B 1/205 118/73 |
| 4,687,011 | A * | 8/1987 | Masaru | B08B 9/0433 134/167 C |
| 5,388,602 | A | 2/1995 | Coassin et al. | |
| 5,573,187 | A * | 11/1996 | Proctor | B05B 13/0627 134/167 C |
| 6,772,774 | B2 * | 8/2004 | Ura | B08B 9/049 134/166 R |
| 7,758,716 | B2 * | 7/2010 | Lee | H05K 3/068 134/103.2 |
| 8,127,891 | B1 * | 3/2012 | Gudinas, Jr. | A61H 35/006 182/129 |
| 2008/0108281 | A1 | 5/2008 | Voges et al. | |
| 2008/0182486 | A1 | 7/2008 | Voges | |
| 2008/0264451 | A1 * | 10/2008 | Shimamura | B23K 37/02 134/22.11 |
| 2009/0227184 | A1 | 9/2009 | Voges et al. | |
| 2011/0114131 | A1 * | 5/2011 | Ying | B08B 9/0813 134/22.12 |
| 2013/0174876 | A1 * | 7/2013 | Greenwood | B08B 9/093 134/24 |
| 2015/0266036 | A1 * | 9/2015 | Andersen | B05B 1/3013 239/563 |

FOREIGN PATENT DOCUMENTS

| | | | |
|---|---|---|---|
| CN | 102284524 | A | 12/2011 |
| CN | 102764778 | A | 11/2012 |
| CN | 103909105 | A | 7/2014 |
| JP | S46036862 | | 12/1971 |
| JP | S5534688 | | 3/1980 |
| JP | S5768217 | | 4/1982 |
| JP | S57142710 | | 9/1982 |
| JP | S5997711 | | 6/1984 |
| JP | H06108277 | | 4/1994 |
| JP | 7-155805 | A | 6/1995 |
| JP | 8-38977 | A | 2/1996 |
| JP | H08038977 | | 2/1996 |
| JP | H0985329 | | 3/1997 |
| JP | 2001170591 | | 6/2001 |
| JP | 2002045813 | | 2/2002 |
| JP | 2002045813 | A * | 2/2002 |
| JP | 2004283680 | | 2/2002 |
| JP | 2002102915 | | 4/2002 |
| JP | 2002144237 | A | 5/2002 |
| JP | 2008229824 | | 10/2008 |
| JP | 5092231 | | 12/2012 |

OTHER PUBLICATIONS

CN102764778—Machine Translation (Year: 2012).*
PCT/CN2015/071909 International Search Report and Written Opinion, dated May 13, 2015.
Office Action dated Jul. 22, 2020 for Korean Patent Application No. 20167027812. English translation provided.

* cited by examiner

MIXED JET DESCALING DEVICE AXIALLY AND ECCENTRICALLY ARRANGED FOR INNER WALL OF PIPE

CROSS-REFERENCE TO RELATED APPLICATIONS

This application is a United States National Stage Application of, and claims the benefit pursuant to 35.U.S.C. § 371 of International Application No. PCT/CN2015/071909, filed on Jan. 30, 2015. PCT/CN2015/071909 claims benefit and priority to Chinese patent application No. 201410124038.X, which was filed on Mar. 28, 2014. Each of the above-referenced applications are hereby incorporated by reference herein in their entirety.

TECHNICAL FIELD

The present invention belongs to the technical field of descaling for inner wall surfaces of cold-state metal pipe having a circular or irregularly shaped cross section, is mainly used to achieve continuous removal of scales on the inner wall surfaces of the cold-state metal pipes by means of a special design of a plurality of jet spraying units arranged eccentrically, and uses the simple straight relative movement between the cold-state metal pipes and a descaling device to achieve uniform removal of scales on the inner wall surfaces of the cold-state metal pipes. The present application is an invention relating to the jet descaling technology for inner wall surfaces of cold-state metal pipes.

BACKGROUND ART

A dense covering composed by a layer of metal oxides tends to form on the surface of a metal material during hot rolling or heat treatment, commonly known as a "scale", and the presence of the scale will affect further processing: on one hand, the surface cracks of the material cannot be easily found in advance, causing quality problems in the processed finished product; and on the other hand, the scales are easily pressed into the metal surface, resulting in surface quality problems; in addition, the presence of hard oxides will accelerate the abrasion of a rolling or drawing machine, and meanwhile make it difficult for the anti-corrosion treatment of the bar to be carried out prior to actual use; furthermore, for special steel bars, in order to expose the surface quality defects of the steel bars, such as cracks, streaks, etc., there is a need to remove the surface scales and expose the body, so that a production worker can easily found the existing defects, and develop appropriate remedial measures.

On this basis, it is required to completely remove the surface scales of the metal pipes after the completion of hot rolling and before proceeding to the post-treatment process.

As regards the surface descaling methods for metal pipes, in view of costs and maturity of the production processes, currently domestic and foreign manufacturers use wet chemical cleaning processes to remove the surface scales; and for the pipes, in general, there are two types of descaling methods, one is blasting, shot peening and other physical descaling methods, and the other is a wet chemical method, which uses sulfuric acid, hydrochloric acid, hydrofluoric acid and other strong acid solutions to achieve the removal of surface scales.

In these methods, the wet chemical acid pickling process has a harsh production environment, and a large amount of residual acid generated during production has to be recycled and regenerated; accordingly, exhaust emissions are necessarily generated in the current regeneration processes, which contain a large amount of acidic, corrosive components, such as HCL, $SO_2$, etc., directly polluting the atmosphere.

Otherwise, if the blasting or shot peening descaling method is used, which generally requires a relatively large operating space, due to the limited space of the inner surface of the pipe, this descaling process does not only result in that the surfaces of the pipes cannot be completely cleaned, but also brings about a lot of dust pollutions, which likewise leads to an extremely harsh working environment in the processing workshop and has poor effects that cannot reach the inner wall surface quality required by the subsequent process.

On this basis, in order to solve the problem in descaling of the surface scales of the pipes, a lot of researches have been conducted and a variety of techniques and pieces of equipment are developed to replace the chemical method for removing the scales on the metal surface, such as electrolytic descaling, electrolytic grinding descaling, electrical discharge descaling, electron beam descaling, laser descaling, grinding descaling, repeated bending descaling and a descaling method by combining different methods mentioned above. High-pressure water jet descaling technology has been developing fastest in the development of these methods in recent years, and the progress of industrialization thereof also becomes increasingly significant.

Through access to relevant patents, we also found that although the foreign countries, especially Japan, Germany and other countries having well-developed metallurgy technologies, have proposed numerous continuous jet, polishing and brushing descaling techniques such as a descaling process combining acid spraying and roller brushing in a continuous cold rolling line disclosed in Japanese patent JP 06108277 A, a method of combining PV rolling scale-breaking and high-pressure mixed abrasive jet descaling disclosed in Japanese patent JP 55034688 A, and Japanese patents JP 57142710 A, JP 57068217 A, JP 59097711 A, and a series of removing techniques for surface scales of steel plates disclosed in US patents US 20080108281 (A1), US 20080182486 (A1) and US 20090227184 (A1), etc. by TMW from Canada since 2001, as well as U.S. Pat. No. 5,388,602 in western Europe, Japanese patents JP 05092231 A, JP 09085329 A and JP 2002102915, none of them proposes a technique for effectively removing surface scales of bars and wires.

SUMMARY OF THE INVENTION

For the descaling of an inner wall of a metal pipe with a larger diameter, since the size of the inner wall of the tube is relatively large, the requirements of geometric space for spray nozzles and jet in the jet descaling process can be fully met, and therefore a simple solution of uniform distribution in the circumferential direction may be adopted to achieve the uniform descaling for the inner wall; while for the inner wall of the metal pipe with a smaller diameter and limited space, it is also necessary to take full account of the space required for arranging the jet spray nozzles and a medium supply pipeline, so that there is a need to adopt a special eccentric arrangement to achieve the descaling for the inner wall. By searching published documents and patents, up to now, no similar publication has been found.

Therefore, an object of the present invention is to design an axially eccentrically arranged mixed jet descaling device for an inner wall of a pipe, which can achieve continuous, highly efficient, stable and environment-friendly descaling for the inner wall surfaces of cold-state metal pipes.

In order to achieve the aforementioned object, a technical solution of the present invention is as follows:

The present invention is directed to a process for continuously descaling a surface of an inner wall of a metal pipe surface by means of an axially eccentric arrangement, and can achieve the purpose of effectively removing scales on the inner wall surface of the metal pipe with a certain diameter by using a simple straight relative movement between mixed jet spray nozzles and the metal pipe.

Specifically, an axially eccentrically arranged mixed jet descaling device for an inner wall of a metal pipe of the present invention comprises a support rod arranged inside the metal pipe, the support rod being parallel to the central axis of the metal pipe, eccentrically arranged and not concentric with the central axis of the metal pipe; and at least two spray nozzle units for spraying a mixed jet, the spray nozzle units being arranged one behind another along the lengthwise direction of the support rod, wherein at least two mixed jet spray nozzles are provided in each spray nozzle unit and uniformly arranged along the circumference of the support rod in such a manner that the mixed jet spray nozzles diverge towards the periphery of the support rod with the axis of the support rod as the center; and the mixed jet spray nozzles of the spray nozzle units arranged one behind another are staggered one behind another in the circumferential direction of the inner wall of the metal pipe to be descaled, thereby forming a mixed jet spray nozzle matrix and creating an effective descaling zone capable of covering the circumferential surface of the inner wall of the metal pipe.

Further, the support rod comprises a first support portion and a second support portion which extends from the end of the first support portion by bending twice spatially and is parallel to the first support portion, axes of the first and second support portions are both arranged eccentrically with identical eccentric values, and the axes are arranged in an angularly staggered manner on a circumference with the central axis of the metal pipe as the center; and the first and second support portions are respectively provided with at least two spray nozzle units, the mixed jet spray nozzles in the spray nozzle units on the first and second support portions are arranged to be staggered one behind another in the circumferential direction of the inner wall of the metal pipe to be descaled, thereby forming a mixed jet spray nozzle matrix and creating a circular effective descaling zone capable of covering the circumferential surface of the inner wall of the metal pipe.

Still further, the axes of the first and second support portions are both arranged on the circumference of a concentric circle with the central axis of the metal pipe as the center, and uniformly arranged on the circumference in an angularly staggered manner.

Still further, the support rod comprises a first support portion, a second support portion which extends from the end of the first support portion by bending twice spatially and is parallel to the first support portion, and a third support portion which extends from the end of the second support portion by bending twice spatially and is parallel to the second support portion, axes of the first, second and third support portions are all arranged eccentrically with identical eccentric values, and the axes are arranged in an angularly staggered manner on a circumference with the central axis of the metal pipe as the center; and the mixed jet spray nozzles in the spray nozzle units on the first, second and third support portions are arranged to be staggered one behind another in the circumferential direction of the inner wall of the metal pipe to be descaled, thereby forming a mixed jet spray nozzle matrix and creating a circular effective descaling zone capable of covering the circumferential surface of the inner wall of the metal pipe.

Still further, the axes of the first, second and third support portions are both arranged on the circumference of a concentric circle with the central axis of the metal pipe as the center, and uniformly arranged on the circumference in an angularly staggered manner.

Furthermore, an angle is formed between the axial direction of the mixed jet spray nozzle and the central axis of the support rod.

Advantages of the present invention are as follows:

the present invention uses an axially eccentric mixed spray nozzle arrangement of multiple units, relies on the simple straight relative movement between the spray units and the inner wall of the pipe, and can achieve uniform and stable descaling effects for the inner wall of the metal pipe with a smaller diameter, so as to reach the goal of efficient descaling.

Compared with conventional descaling processes, the method of using a mixed jet to descale the inner wall of the cold-state pipe has a more environmentally friendly descaling process, and the production cost has a stronger competitive advantage.

PREFERRED EMBODIMENTS OF THE INVENTION

Figure 1:
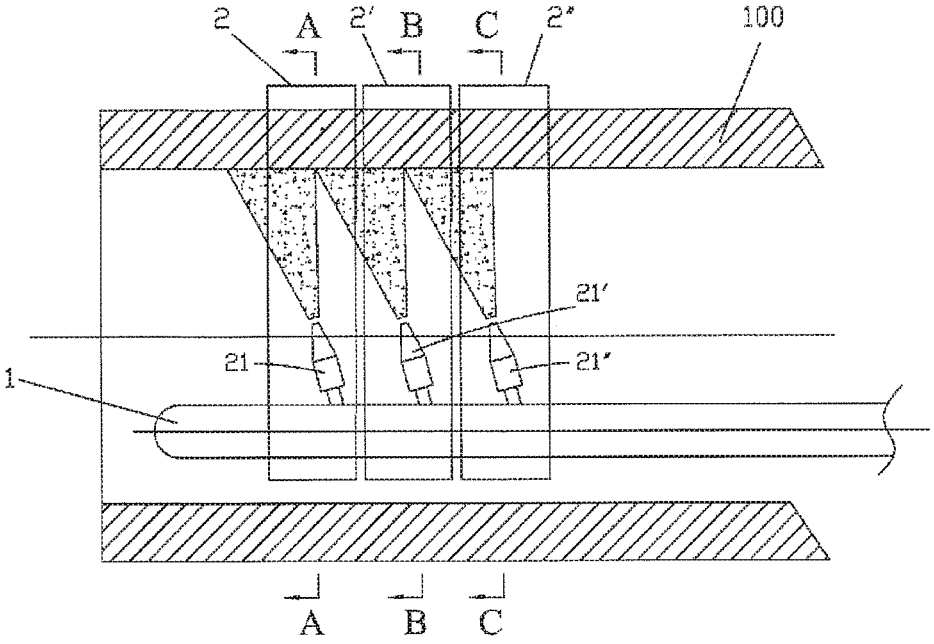
FIG. 1 is a structural schematic view of a first embodiment of the present invention.
Figure 2:
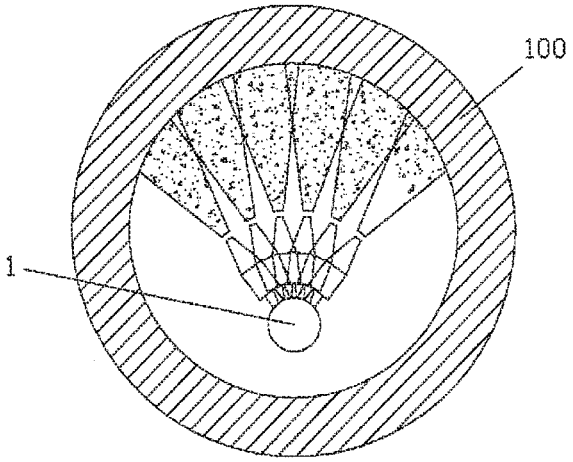
FIG. 2 is a side view of FIG. 1.
Figure 3:
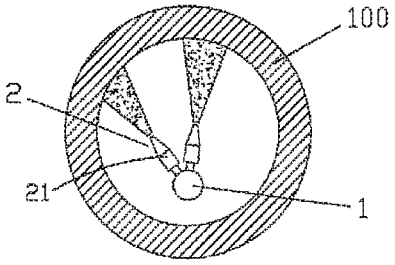
FIG. 3 is a sectional view taken through A-A of FIG. 1.
Figure 4:
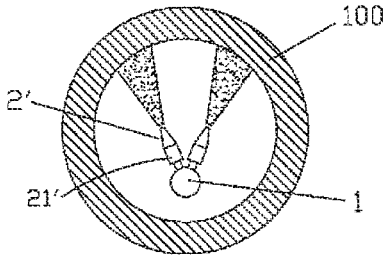
FIG. 4 is a sectional view taken through B-B of FIG. 1.
Figure 5:
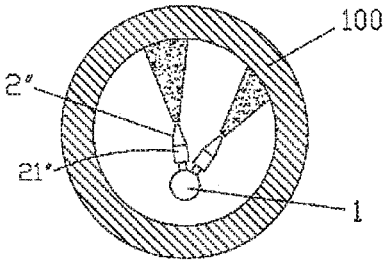
FIG. 5 is a sectional view taken through C-C of FIG. 1.

Referring to FIGS. 1-5, an axially eccentrically arranged mixed jet descaling device for an inner wall of a metal pipe of the present invention comprises a support rod 1 arranged inside the metal pipe 100 to be descaled, the support rod being parallel to the central axis of the metal pipe 100, eccentrically arranged and not concentric with the central axis of the metal pipe; and three spray nozzle units 2, 2', 2" for spraying a mixed jet, the spray nozzle units being arranged one behind another along the lengthwise direction of the support rod, wherein at least two mixed jet spray nozzles 21, 21', 21" are provided in each spray nozzle unit 2, 2', 2" and uniformly arranged along the circumference of the support rod 1 in such a manner that the mixed jet spray nozzles diverge towards the periphery of the support rod with the axis of the support rod 1 as the center; and the mixed jet spray nozzles of the spray nozzle units 2, 2', 2" arranged one behind another are staggered one behind another in the circumferential direction of the inner wall of the metal pipe to be descaled, thereby forming a mixed jet spray nozzle matrix and creating an effective descaling zone capable of covering the circumferential surface of the inner wall of the metal pipe. A larger spacing and a smaller spacing exist between the support rod 1 and the inner wall of the metal pipe 100, the greater spacing is larger than the smaller spacing, i.e., as shown in the figures, the spacing between the upper inner wall and the support rod is the larger spacing and the spacing between the lower inner wall and the support rod is the smaller spacing, the upper inner wall and the lower inner wall are divided by a horizontal line of the support rod, and the mixed jet spray nozzles 21, 21', 21" are arranged on the side of the support rod having the larger spacing between the support rod 1 and the inner wall 100.

Figure 6:
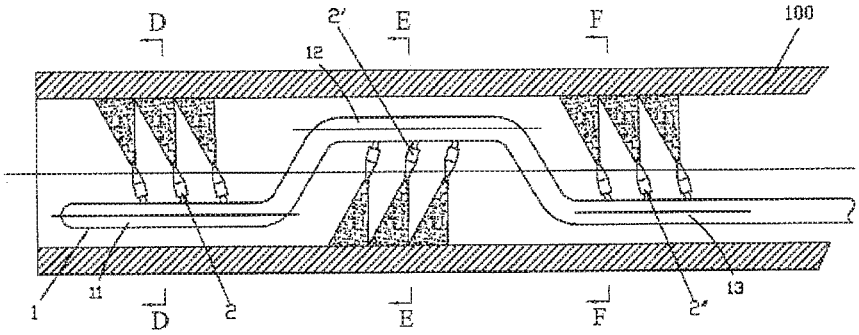
FIG. 6 is a structural schematic view of a second embodiment of the present invention.
Figure 7:
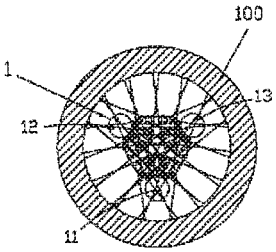
FIG. 7 is a side view of FIG. 6.
Figure 8:
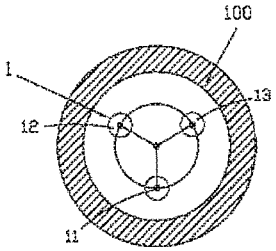
FIG. 8 is a structural schematic view of a support rod in the second embodiment of the present invention.
Figure 9:
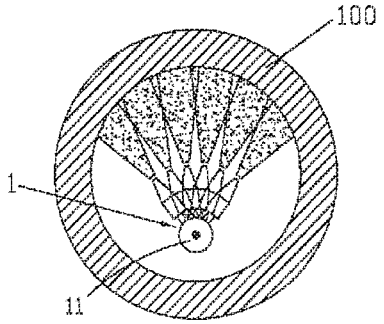
FIG. 9 is a sectional view taken through D-D of FIG. 6.
Figure 10:
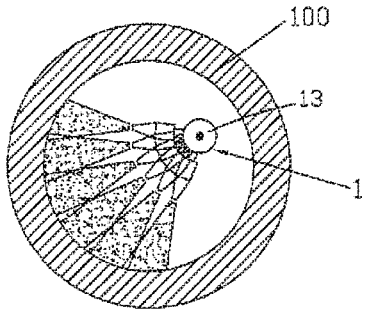
FIG. 10 is a sectional view taken through E-E of FIG. 6.
Figure 11:
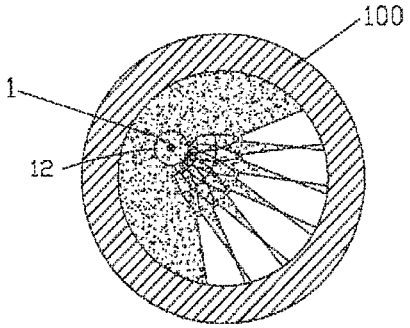
FIG. 11 is a sectional view taken through F-F of FIG. 6.

Referring to FIGS. 6-11, which show the second embodiment of the present invention, the support rod 1 comprises a first support portion 11, a second support portion 12 which extends from the end of the first support portion 11 by bending twice spatially and is parallel to the first support portion 11, and a third support portion 13 which extends from the end of the second support portion 12 by bending twice spatially and is parallel to the second support portion 12, axes of the first to third support portions 11-13 are all arranged eccentrically with identical eccentric values, and the axes are arranged in an angularly staggered manner on a circumference with the central axis of the metal pipe 100 as the center; and the mixed jet spray nozzles in the spray nozzle units 2, 2', 2" on the first to third support portions 11-13 are arranged to be staggered one behind another in the circumferential direction of the inner wall of the metal pipe to be descaled, thereby forming a mixed jet spray nozzle matrix and creating a circular effective descaling zone capable of covering the circumferential surface of the inner wall of the metal pipe 100.

In addition, the axes of the first to third support portions 11-13 are all arranged on the circumference of a concentric circle with the central axis of the metal pipe 100 as the center, and uniformly arranged on the circumference in an angularly staggered manner.

Furthermore, an angle is formed between the axial direction of the mixed jet spray nozzle and the central axis of the support rod.

The spray nozzle units of the present invention are all fixed on an eccentric tortuous support rod, and the mixed jet spray nozzles in each spray nozzle unit are arranged in a diverging manner in accordance with the respective center, namely, the mixed jet is formed in a diverging manner; and the mixed jet spray nozzles in each spray nozzle unit are uniformly arranged in the circumferential direction of a circular cross section of the pipe in a typically eccentrically diverging form, the values of staggered angles between every two spray nozzles in the same spray nozzle unit in the circumferential direction of the cross section are the same, namely when three spray nozzle units overlap, it can be seen from the view in the overlapping direction that the values of staggered angles between every two adjacent spray nozzles in the circumferential direction of the cross section are the same after the three individual spray nozzles overlap.

In this way, when the pipe moves straight in the axial direction, and all the spray nozzle units are spraying and remain stationary, the scales of the inner wall of the pipe are completely removed after the inner wall of the pipe completely pass through all the spray nozzle units.

The present invention takes full advantage of the mixed jet descaling effect and the cross section properties of the pipe, and uses this high-pressure jet method to achieve high-speed continuous descaling for the pipe.

The invention claimed is:

1. A mixed jet descaling device for descaling an inner wall of a metal pipe, said mixed jet descaling device comprising:

a support rod configured to be used inside the metal pipe, wherein said support rod comprises a single tortuous rod having a first support portion and a second support portion extending from an end of the first support portion by bending the support rod spatially, wherein each axis of the first and second support portions are parallel and eccentric relative to a central axis of the support rod;

at least two spray nozzle units are fixed on the support rod, each spray nozzle unit comprising at least two jet spray nozzles configured to spray a mixed abrasive medium to remove metal oxide scales formed on the inner wall of the metal pipe during hot rolling or heat treatment, wherein the spray nozzle units are mounted on each of the first and second support portions of the support rod along a lengthwise direction thereof in axially eccentric positions relative to the central axis, and an angle is formed between an axial direction of the jet spray nozzles and the central axis of the support rod, wherein each jet spray nozzle is oriented at a non-perpendicular angle relative to the respective axis of the first or second support portion on which each spray nozzle is mounted, the jet spray nozzles are configured in a diverging manner with the respective axis of the first and second support portions as a respective center; and wherein the mixed jet descaling device is arranged inside the metal pipe without being in contact with the metal pipe, wherein the jet spray nozzles form a matrix of mixed abrasive medium, wherein said matrix provides a descaling zone capable of covering a circumferential surface of the inner wall of the metal pipe, and wherein a straight relative movement between the jet spray nozzles and the metal pipe remove the metal oxide scales formed on the inner wall of the metal pipe.

2. The mixed jet descaling device of claim 1, wherein the second support portion of the support rod extends from the end of the first support portion by bending twice spatially.

3. The mixed jet descaling device of claim 1, wherein in a projection plane perpendicular to the central axis of the support rod in the metal pipe, the axes of the first and second support portions are both configured on a concentric circle with the central axis of the support rod as the center, and are configured on the concentric circle in an angularly staggered manner.

4. The mixed jet descaling device of claim 1, wherein the support rod further comprises a third support portion which is used for arranging the spray nozzle units, said third support portion extends in the lengthwise direction from an end of the second support portion by bending the support rod spatially, and an axis of the third support portion is eccentric relative to the central axis of the support rod.

5. The mixed jet descaling device of claim 4, wherein the third support portion of the support rod extends from the end of the second support portion of the support rod by bending the support rod twice spatially, and wherein the third support portion is parallel to the second support portion of the support rod.

6. The mixed jet descaling device of claim 4, wherein in a projection plane perpendicular to the central axis of the support rod in the metal pipe, the axes of the first, second and third support portions are all arranged on a concentric circle with the central axis of the support rod as the center, and are configured on the concentric circle in an angularly staggered manner.

7. A descaling system for descaling an inner wall of a metal pipe, comprising:

a metal pipe having an inner wall; and the mixed jet descaling device of claim 1;

wherein the mixed jet descaling device is arranged inside the metal pipe to descale metal oxide formed on the inner wall of the metal pipe.

* * * * *